US005903984A

United States Patent [19]

Donnadieu et al.

[11] Patent Number: 5,903,984

[45] Date of Patent: May 18, 1999

[54] SPORTS BOOT HAVING AN ENERGIZING DEVICE

[75] Inventors: Thierry Donnadieu, Poisy; Eric Girault, Annecy, both of France

[73] Assignee: Salomon S.A., Metz-Tessy, France

[21] Appl. No.: 08/922,447

[22] Filed: Sep. 3, 1997

[30] Foreign Application Priority Data

Sep. 13, 1996 [FR] France ..... 96 11356

[51] Int. Cl.[6] ..... A43B 5/00

[52] U.S. Cl. ..... 36/118.2; 36/117.2; 36/118.3

[58] Field of Search ..... 36/117.1, 117.2, 36/118.2, 118.3, 119.1

[56] References Cited

U.S. PATENT DOCUMENTS

| | | | |
|---|---|---|---|
| 5,369,897 | 12/1994 | Rullier | 36/117 |
| 5,406,721 | 4/1995 | Marcolin | 36/117.2 |
| 5,446,976 | 9/1995 | Donnidieu et al. | 36/117 |
| 5,611,155 | 3/1997 | Brown et al. | 36/118.2 |

FOREIGN PATENT DOCUMENTS

| | | | |
|---|---|---|---|
| 0514642 | 11/1992 | European Pat. Off. . | |
| 0596281 | 5/1994 | European Pat. Off. . | |
| 2492668 | 4/1982 | France . | |
| 2666201 | 3/1992 | France | 36/117.2 |
| 2697728 | 5/1994 | France . | |
| WO95/21549 | 8/1995 | WIPO . | |

*Primary Examiner*—M. D. Patterson
*Attorney, Agent, or Firm*—Greenblum & Bernstein P.L.C.

[57] ABSTRACT

A sports boot, especially intended for the practice of gliding sports, made from an external sole adapted to be affixed onto a glide member and including an upper equipped with a stiff rear portion on which is laterally journalled a collar adapted to surround the lower part of the user's leg, such collar extending upwardly from its lateral journal. The collar is capable of pivoting towards the rear about its journal against the energizing return device interspersed between the collar and the upper, wherein the return device includes a substantially semi-circular upper arm, anchored laterally by each of its ends on the collar, and a lower portion connected to the upper arm and in abutment against a lower abutment of the upper.

19 Claims, 3 Drawing Sheets

13
18
18 a
13 b
19
17
B
13 a
23
15
13 c
A
x
22
20
30
16
21
12
11a
14
11
10

SPORTS BOOT HAVING AN ENERGIZING DEVICE

BACKGROUND OF THE INVENTION

1. Field of the Invention

The present invention is related to a sports boot intended for practicing a sport, especially sports involving gliding, such as cross country skiing or skating, and is of the type constituted of an external sole and an upper equipped with a rear spoiler about which a rigid collar is journalled, the collar extending upwardly from the journal, and adapted to enclose the lower part of the leg.

2. Description of Background and Relevant Information

While skating during cross country skiing, when the skier completes his/her propulsion on one of the skis, he/she transfers his/her weight to the other ski and brings the first ski up to the level of the second. This forward motion differs according to:

the speed (thus the step used); and the slope encountered.

Regarding the speed, the slower the speed, the greater the skating frequency, and thus the skier has less time to bring his/her ski forward. This is why, the slower the speed, the less the chances of the ski being brought into parallel, and the greater the chances of the skier keeping a substantial divergence between the two skis.

Regarding the slope encountered, the skier must bring his/her ski into a forward position that is as parallel as possible with respect to the slope so as not to raise it too much. The inclination of the ski during the forward motion thus depends on the slope encountered, and this renders the forward motion especially demanding and difficult when the slopes are steep.

An analysis of the movement reveals, in fact, that during the disengagement of the ski, the front end or shovel thereof grips the snow, and this causes the problem of the longitudinal angular control of the ski in the quasi-static phase, i.e., when it is in the air. The same problem is encountered in other gliding sports, such as ice skating, roller blading or line skating, in which the sportsman must avoid hitting the ground with the glide element during the forward motion phase.

It has also been ascertained previously that there is another disadvantage for the skier in that he/she must increase the contraction of the front shin in order to raise the ski and avoid the shovel from gripping the snow during the forward motion phase of the ski. This contraction causes a fatigue which is all the more harmful for the skier because he/she should be able to take advantage of this phase in order to relax the muscles of the concerned leg as much as possible, because this happens to be a resting, non-motor phase.

The Applicant has already overcome these disadvantages by setting forth, in its previous French patent application No. 2 492 668, a boot of the above-cited type equipped with an energizing device for the longitudinal angular control of the ski in the air with respect to the sole of the boot during the forward motion phase of the ski.

In the Applicant's French patent application No. 2 697 728, the Applicant has also made provisions for the energizing device to be rendered inactive in the thrusting phase so as not to create any additional fatigue.

One of the energizing devices for longitudinal angular control as described in the French patent application No. 2 697 728 consists of a simple return pin anchored in the area of the lateral journal axes of the collar comprising two semi-circular arms arranged in a V and in support, on the one hand, against the base of the collar, and on the other hand, against an abutment arranged on the rear spoiler of the upper.

Although such means are effective in overcoming the above-cited disadvantages, they do, however, cause comfort problems in the rear area of the boot, and they do not provide for the possibility of providing a lateral clearance on the collar with respect to the upper. Indeed, the actuation of the energizing device is done by means of the rear portion of the collar taking support on the upper arm of the pin, and this causes problems of over-pressure and discomfort in this area. In addition, providing a lateral clearance for the journal of the collar causes a delayed, and thus undesirable activation of the pin anchored on the journal.

However, such a clearance is necessary for the skier in order to adapt the upper of the boot to the axis of the lower part of his leg with respect to the seating of the foot, and to enable the practice of the sport while respecting the natural movements of the foot with respect to the leg.

SUMMARY OF THE INVENTION

It is an object of the instant invention to overcome the latter disadvantages, while retaining the advantages obtained by the constructions disclosed in the preceding patent applications, i.e., with an energizing device acting in a longitudinal direction during the forward motion.

This object is achieved in the sports boot as per the invention which is of the type having an external sole and comprising an upper equipped with a stiff rear portion on which a collar is laterally journalled, the collar intended to surround the lower part of the user's leg, and extends upwardly from its lateral journal, the collar being able to pivot towards the rear about its journal against the energizing return device interspersed between the collar and the upper, wherein the return device includes a substantially semi-circular upper arm, anchored laterally by each of its ends on the collar, and a lower portion connected to the upper arm and in abutment against a lower abutment of the upper.

The fact that the return device is anchored laterally on the collar allows the activation of the return device by these lateral anchors, and thus enables the problems of over-pressure linked to the activation of the known return device by the rear lower portion of the collar to be avoided.

Advantageously, the lower portion of the return device of the sport boot according to the invention includes:

- a first lower arm having a substantially semicircular shape, cooperating with the abutment of the upper via its central portion; and
- a second intermediate arm having a substantially semi-circular shape that is connected, on the one hand, to the lower arm by its lateral ends by forming a double V configuration, whereby the two V's are open towards the rear of the boot, and each of whose peaks A is connected to a lower lateral journal axis of the collar, and on the other hand, to the upper arm via its central portion by forming a second W, open towards the front of the boot and whose peak B is defined by the central portions of the two arms and that extends at a distance from the upper.

In this way, one is able to construct a first lower energizing pin constituting the first energizing device for longitudinal angular control, and a second upper energizing pin constituting the second energizing device for longitudinal angular control.

The instant invention is also related to the characteristics that will become apparent from the description that follows and that should be taken into consideration either singly or in any possible technical combinations thereof.

BRIEF DESCRIPTION OF THE DRAWINGS

This description, provided as a non-limiting example, will better explain how the invention can be obtained, with reference to the annexed drawings wherein.

DETAILED DESCRIPTION OF THE PREFERRED EMBODIMENTS

Figure 1:
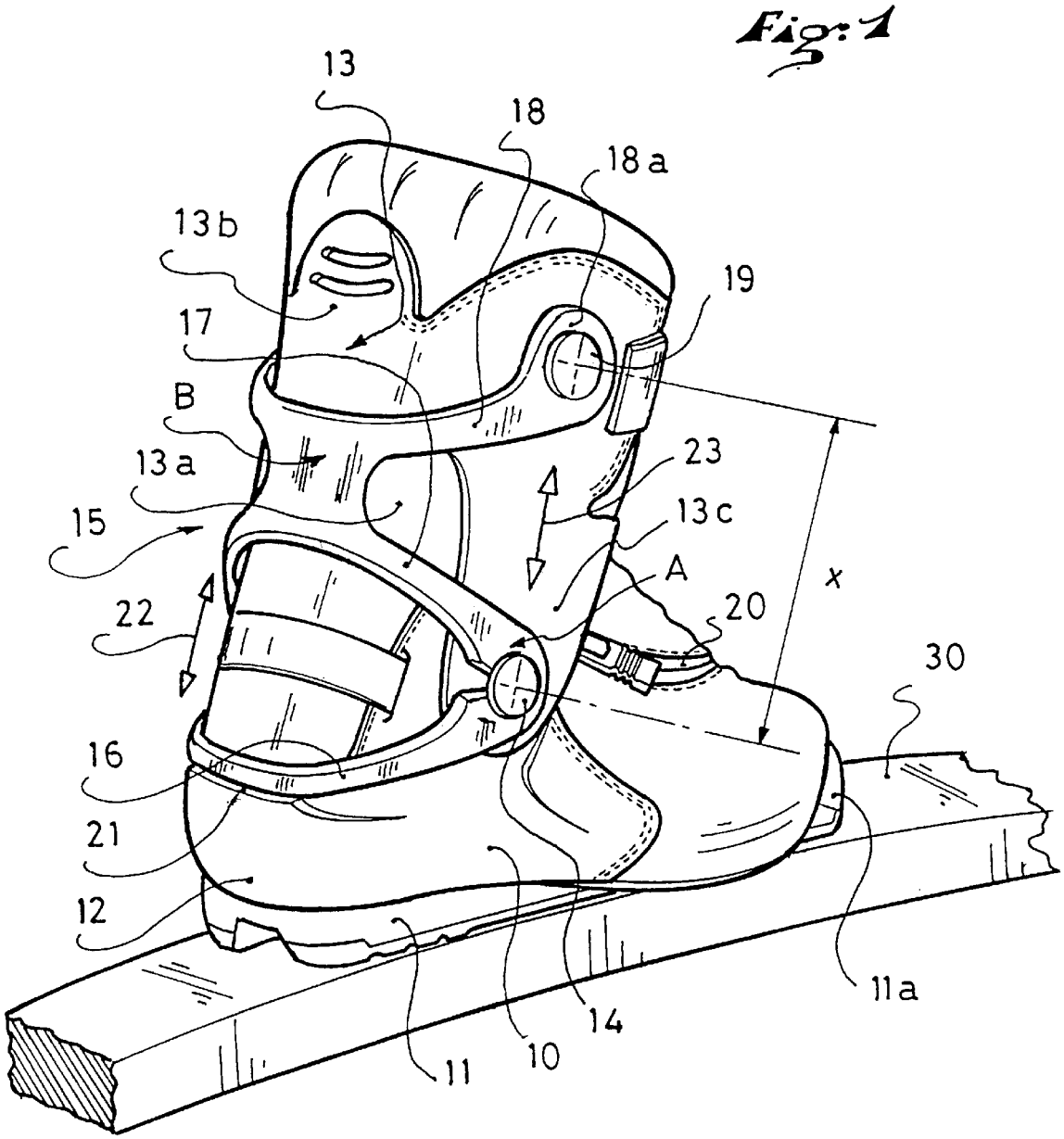
FIG. 1 is a perspective view of a cross country ski boot of the skating type, mounted on a ski and provided with energizing device as per one embodiment of the invention.
Figure 2:
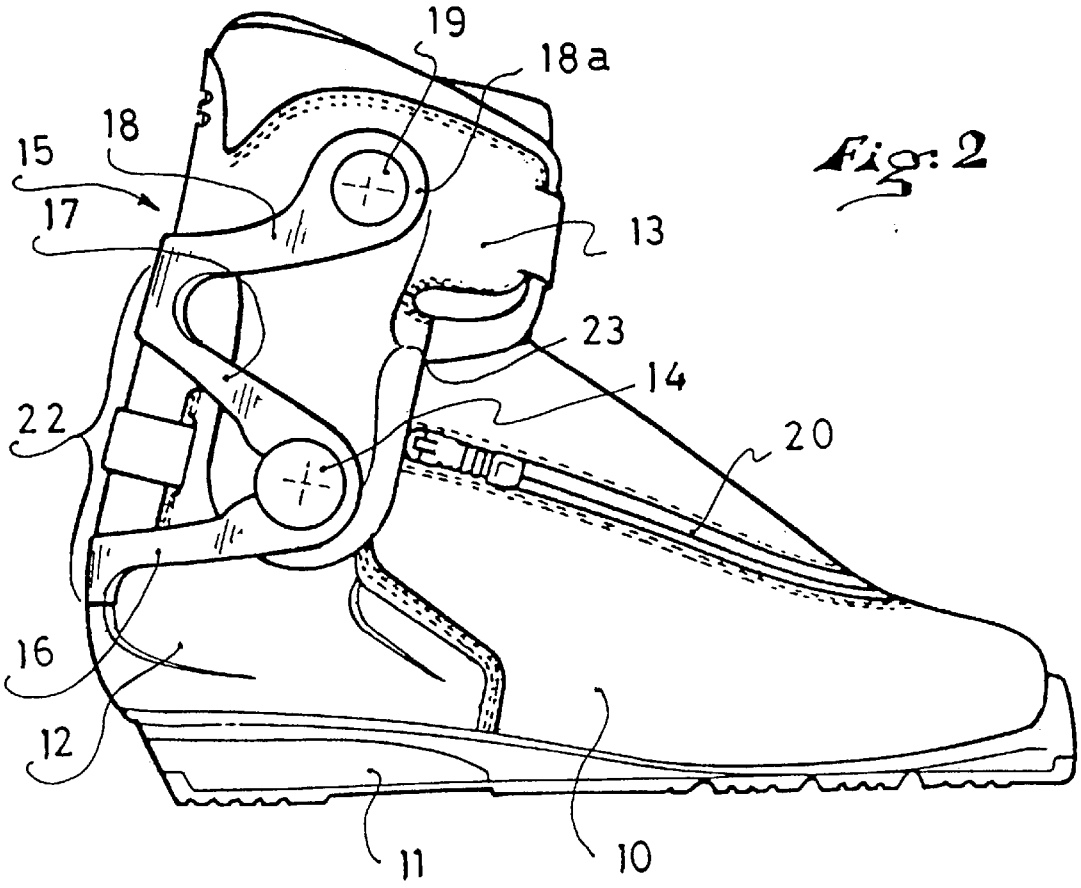
FIG. 2 is a side view of the boot shown in FIG. 1.

The boot represented as an example in FIG. 1 is especially adapted for the skating step and, externally, it has the appearance of a known type of boot constituted of an upper 10, a sole 11 and a closure system 20 for putting on and removing the boot, and it encloses an internal lacing system.

In a traditional manner, the sole 11 can be fixed to a ski 30 by its front portion 11*a* via a binding that has not been represented in the drawing.

In the case of a cross country ski boot, the upper 10 is made of a flexible material and in the area of the heel, it is equipped with a stiff rear portion, which happens to be a rear or heel stiffener 12 that can be made in a known manner. This rear stiffener is stiff, and is preferably made of a synthetic material, and extends along the entire rear portion of the about, and completely surrounds the heel thereof.

The rear stiffener 12 also extends into the zone of the malleoli up to the top of upper 10, if it happens to be a low upper, in order to receive a journalled collar 13, such collar also being stiff and affixed in a known manner to each side of the stiffener, and substantially at the level of the malleoli via a journal axis 14. The journalled collar 13 can be constituted of a packing obtained from a synthetic material, such as the material known under the trade name PEBAX.

The collar 13 extends upwardly to the base of the calf and encircles the entire lower part of the leg. It is open at its front part in order to enable the foot to be inserted into the boot and is also equipped with a known tightening mechanism, not shown, and these can be constituted, for example, by self-adhering means.

This collar 13 is also equipped at the rear with a wide scallop 13*a* intended to facilitate the rotation of such collar without adversely affecting the rear stiffener. In fact, it is shaped like a semi-circular packing 13*b* journalled to the stiffener 12 via two lateral legs 13*c*.

Towards the rear, the collar 13 is capable of pivoting about each of its journal axes 14 against the energizing device 15 interspersed between a fixed rear abutment of the upper 10 and the journalled collar 13.

According to the invention, this device 15 is constituted of a double energizing pin that is elastically deformable and arranged in an enveloping manner at the rear and on the sides of the boot, the double pin 15 being constituted of:

- a first substantially semi-circular lower arm 16 adapted to cooperate with a lower abutment 21 of the rear stiffener 12 of upper 10, and extending towards the rear from one side to the other of the boot;
- a second intermediate arm 17 similar to the lower arm 16, connected thereto by its ends, and forming therewith a first double configuration, whereby the two V's are open towards the rear of the boot, and each of whose peaks A moves about a lower journal axis 14 of the collar 13 on upper 10;
- a third upper arm, also semi-circular, connected via median portion to the median portion of the second intermediate arm 17 by forming a second double configuration with peaks B open towards the front of the boot, and whose peak B is devoid of any connection with the boot, each of the free ends 18*a* of the third upper arm 18 being affixed by an upper lateral axis 19 to the top of collar 13.

Such a construction enables the constitution of a first lower energizing pin 22 open towards the rear and constituting the first energizing device for longitudinal angular control, and a second double upper energizing pin 23 open laterally towards the front and constituting the second energizing device for longitudinal angular control.

By virtue of the rear abutment 21 and the absence of any retention device towards the front of collar 13, the longitudinal energizing device constituted by the lower energizing pin 22 are inactive in a median equilibrium position of the collar 13 with respect to the upper 10 towards the front, and are active only after the rotation of the collar 13 from this same median position towards the rear.

With regard to the lateral energizing device constituted by the upper energizing pin 23, such means are inactive longitudinally during a displacement of the collar 13, both towards the front and towards the rear; however, the third upper arm 18 of the energizing pin 23 plays the role of a force transmitter when the collar 13 is tilted towards the rear, and has the effect of compressing the lower energizing pin 22 and placing the first lower arm 16 in contact against the lower abutment 21 of the upper 10.

More particularly, the fact that the upper arm 18 is anchored laterally on the collar 13, and is thus no longer activated by the lower end thereof, as was the case in FR 2 697 728, enables the pressure forces to be distributed over the entirety of collar 13, and enables the problems of over pressure linked to activation via the rear lower portion of the collar to be avoided.

In addition, comfort is also heightened by the fact that the elastic energizing pin 15, and especially its upper arm 18 extend at a distance, radially, from collar 13 (see FIG. 4) such that any risk of the interference of the energizing pin 15 with the collar 13 during a rotation thereof is eliminated. For even greater comfort, a shock absorbing means can also be interspersed between the abutment 21 and the lower arm 16 of the energizing pin.

The upper arm 23 also provides energizing in the transverse direction of the boot and thus enables a better control of the foot/ankle angulation in the transverse direction to be obtained, as well as better proprioceptive information about the position and the transverse angulation of the ankle with respect to the ski-snow contact surface.

Figure 4:
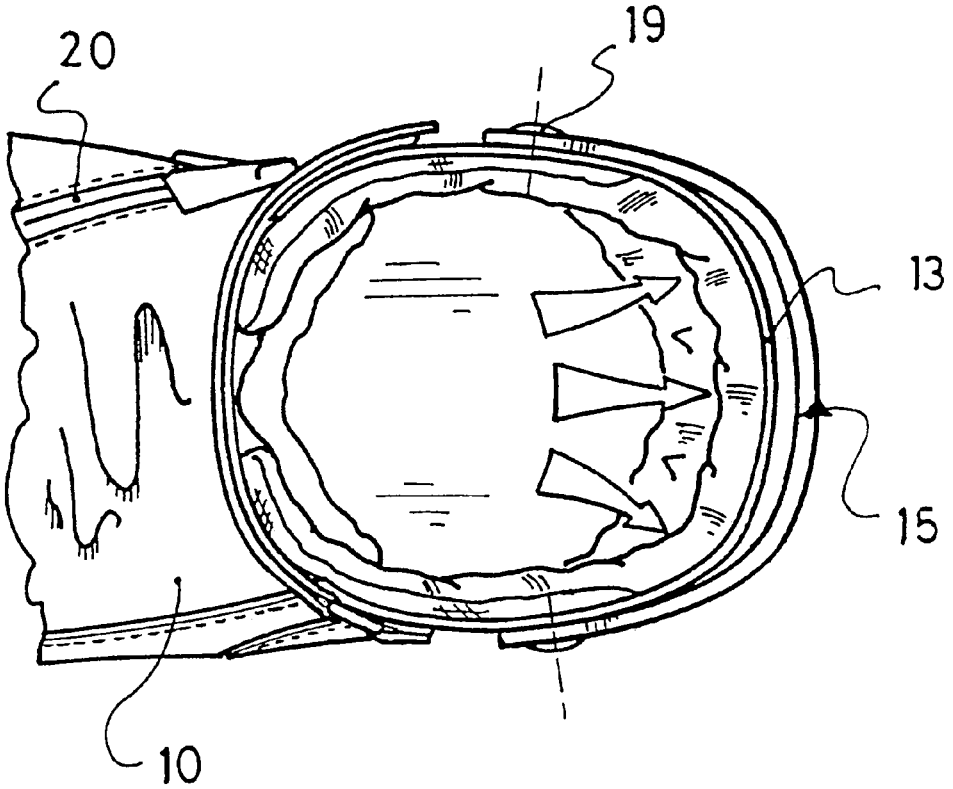
FIG. 4 is a partial top view of the boot shown in FIG. 2.

As has been shown especially clearly in FIGS. 1 and 4, the peaks of the intermediate 17 and upper 18 arms forming the upper energizing pin 23 and extending in an enveloping manner along each of the lateral sides of the boot, come together in a common central zone B located at the rear of the boot, at a distance therefrom, by forming an X.

According to a first embodiment example, the connection of the collar on upper 10 is done by means of circular holes obtained at the ends of the lateral extensions 13*b* of the collar, and each of these is adapted to cooperate with a corresponding lower lateral journal axis 14, located on either side of the boot for a rotational assembly of the collar, on which is also journalled a lower energizing pin 22, such that the center axis distance x between the lower journal 14 and the upper journal 19 remains constant, the actuation of the energizing device for lateral control, constituted by the upper energizing pin 23 only being permitted within the limits of the collar's 13 own flexibility. In this case, the collar 13 can be equipped with appropriate scallops so as to enable a certain transverse bending.

Figure 3:
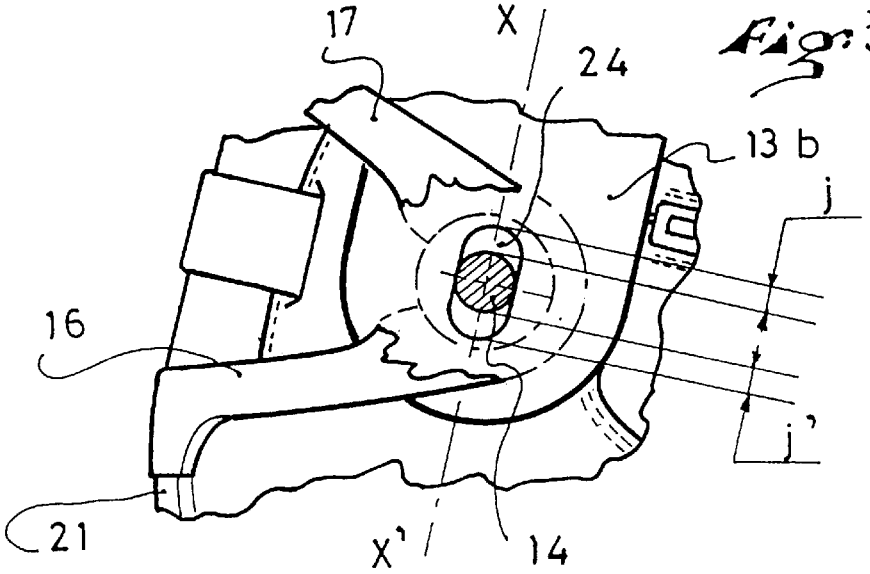
FIG. 3 is an enlarged detail, and a partial sectional view of the lower journal of the collar.

According to another embodiment, illustrated in FIG. 3, the connection of the collar 13 on upper 10 is done along at least one of the sides of the boot by means of an oblong hole 24 obtained, along a direction X, X', substantially vertically to the collar, along an end of the lateral extension 13*b* of the collar 13 and is adapted to cooperate with a clearance J+J' with a corresponding lower lateral journal axis 14 so as to enable a slight vertical displacement of the collar during its rotation in order to account for the natural journal of the ankle.

The clearance J+J" has only been represented in FIG. 3 as an example thereof, and it can be distributed in any appropriate manner with respect to the journal axis 14.

In an embodiment such as this, the assembly of the peaks A of the lower energizing pin 22 defined by the ends of the arms 16, 17 about the fixed journal axes 14 is not modified, and is thus undertaken without any clearance. Due to this fact, the journal assembly, with clearance, of the collar 13 has no impact on the assembly of the double energizing pin 22–23, and such pin is stressed directly, without any delay effects linked to the clearance, as soon as the collar 13 begins to pivot towards the rear.

According to an advantageous characteristic of the invention, the double energizing pin 15 with three arms 16, 17, 18, constituting the longitudinal 22 and lateral 23 energizing device is obtained integrally by molding of a plastic material.

The instant application is based upon the French priority patent application No. 96.11356, filed on Sep. 13, 1996, the disclosure of which is hereby expressly incorporated by reference thereto, and the priority of which is hereby claimed under 35 USC 119.

What is claimed is:

1. A sports boots for gliding sports comprising:

an external sole;

an upper extending upwardly from said external sole, said upper including a rear stiffener and a lower abutment;

a collar adapted to surround the lower part of a user's leg, a lateral journal connecting said collar and said upper to facilitate forward and rearward pivoting of said collar on said upper, said collar extending upwardly from said lateral journal;

an energizing return device positioned between said collar and said upper, said return device comprising a substantially semi-circular upper portion having laterally opposed ends anchored above said journal at respective lateral portions of said collar, said return device further comprising a lower portion affixed to said upper portion, said lower portion of said return device being in abutment with said lower abutment of said upper.

2. A sports boot according to claim 1, wherein:

said substantially semi-circular upper portion extends upwardly to said laterally opposed ends.

3. A sports boot according to claim 1, wherein:

said journal between said collar and said upper comprises a pair of laterally opposed journal connections.

4. A sports boot according to claim 3, wherein:

said collar includes downwardly extending lateral collar extensions, each of said collar extensions including a circular hole; and each of said journal connections includes a respective journal axle closely fitting with a respective one of said holes in said collar extensions to maintain constant, on each lateral side of said collar, a distance between one of said journal connections and a point at which one of said laterally opposed ends of said upper portion is anchored to said collar.

5. A sports boot according to claim 3, wherein:

said collar includes downwardly extending lateral collar extensions, each of said collar extensions including an upwardly extending oblong hole; and each of said journal connections includes a respective journal axle extending through a respective one of said oblong holes in said collar extensions to facilitate displacement of said collar during pivoting of said collar.

6. A sports boot according to claim 1, wherein:

said upper portion and said lower portion of said return device form a unitary element from plastic material.

7. A sports boot according to claim 1, wherein:

said collar is journalled on said rear stiffener of said upper.

8. A sports boots for gliding sports comprising:

an external sole;

an upper extending upwardly from said external sole, said upper including a rear stiffener and a lower abutment;

a collar adapted to surround the lower part of a user's leg, laterally opposed journal connections connecting said collar and said upper to facilitate forward and rearward pivoting of said collar on said upper, said collar extending upwardly from said lateral journal connection;

an energizing return device positioned between said collar and said upper, said return device comprising:

a substantially semi-circular upper portion, said upper portion comprising an upper arm having laterally opposed ends anchored above respective ones of said journal connections at respective lateral portions of said collar;

a lower portion affixed to said upper portion comprising:

a substantially semi-circular lower arm having a lower central portion in abutment with said lower abutment of said upper and laterally opposed ends extending to respective ones of said journal connections;

a substantially semi-circular intermediate arm having laterally opposed ends extending to respective ones of said journal connections and being connected at said journal connections to said lower arm, said intermediate arm being connected to a central part of said upper arm of said upper portion of said return device.

9. A sports boot according to claim 8, wherein:

a central part of said intermediate arm is connected to a central part of said upper arm of said upper portion of said return device, said central parts being spaced from said collar.

10. A sports boot according to claim 9, wherein:

said central parts are spaced rearwardly from said collar.

11. A sports boot according to claim 8, wherein:

a central part of said intermediate arm is connected to a central part of said upper arm of said upper portion of said return device, said central parts not abutting said collar.

12. A sports boot according to claim 8, wherein:

said upper arm, said intermediate arm, and said lower arm form a unitary element from plastic material.

13. A sports boot according to claim 8, wherein:

said intermediate arm and said lower arm form the shape of two V's opening rearwardly and have peaks at respective ones of said journal connections; and said intermediate arm and said upper arm form the shape of two V's opening forwardly and have peaks at respective central parts of said intermediate arm and said upper arm.

14. A sports boot according to claim 13, wherein:

said central parts are spaced from said collar.

15. A sports boot according to claim 13, wherein:

said central parts are spaced rearwardly from said collar.

16. A sports boot according to claim 8, wherein:

said collar is journalled on said rear stiffener of said upper.

17. A sports boot according to claim 8, wherein:

said collar includes downwardly extending lateral collar extensions, each of said collar extensions including a circular hole; and each of said journal connections includes a respective journal axle extending through a respective one of said collar extensions to maintain constant, on each lateral side of said collar, a distance between one of said journal connections and a point at which one of said laterally opposed ends of said upper portion is anchored to said collar.

18. A sports boot according to claim 8, wherein:

said collar includes downwardly extending lateral collar extensions, each of said collar extensions including an upwardly extending oblong hole; and each of said journal connections includes a respective journal axle extending through a respective one of said oblong holes in said collar extensions to facilitate displacement of said collar during pivoting of said collar.

19. A sports boot according to claim 8, wherein:

said substantially semi-circular upper portion extends upwardly to said laterally opposed ends.

* * * * *